US009273938B2

(12) United States Patent
McCarty

(10) Patent No.: US 9,273,938 B2
(45) Date of Patent: Mar. 1, 2016

(54) ARCHERY TARGET WITH COATED LINER

(71) Applicant: J&L Targets, Inc., Janesville, WI (US)

(72) Inventor: Matthew McCarty, Grand Blanc, MI (US)

(73) Assignee: J&L TARGETS, INC., Janesville, WI (US)

( * ) Notice: Subject to any disclaimer, the term of this patent is extended or adjusted under 35 U.S.C. 154(b) by 229 days.

(21) Appl. No.: 13/891,930

(22) Filed: May 10, 2013

(65) Prior Publication Data

US 2014/0333029 A1 Nov. 13, 2014

(51) Int. Cl.
*F41J 3/00* (2006.01)

(52) U.S. Cl.
CPC ..... *F41J 3/0004* (2013.01); *Y10T 29/49885* (2015.01)

(58) Field of Classification Search
CPC ..... F41J 3/00; F41J 3/0004; F41J 3/0009; F41J 1/10
USPC ..... 273/403, 404, 407, 408
See application file for complete search history.

(56) References Cited

U.S. PATENT DOCUMENTS

| | | | | | |
|---|---|---|---|---|---|
| 3,367,660 | A * | 2/1968 | Di Maggio | 273/404 |
| 3,762,709 | A * | 10/1973 | Roloff et al. | 273/404 |
| 4,235,444 | A * | 11/1980 | Meyer | 273/403 |
| 4,491,328 | A * | 1/1985 | Meyer | 273/403 |
| 4,695,060 | A * | 9/1987 | Pilgrim | 273/404 |
| 4,850,596 | A * | 7/1989 | Olund | 273/408 |
| 5,354,066 | A * | 10/1994 | Swanson et al. | 273/408 |
| 5,498,001 | A * | 3/1996 | Franks et al. | 273/403 |
| 5,649,708 | A * | 7/1997 | Podlesny | 273/403 |
| 5,865,440 | A * | 2/1999 | Pulkrabek | 273/408 |
| 5,924,694 | A * | 7/1999 | Kent | 273/408 |
| 6,435,512 | B1 * | 8/2002 | Beckwith, Sr. | 273/407 |
| 7,581,733 | B2 * | 9/2009 | Branch et al. | 273/408 |
| 2004/0036221 | A1 * | 2/2004 | Martinez | 273/373 |
| 2006/0202425 | A1 * | 9/2006 | Pulkrabek | 273/404 |
| 2008/0061509 | A1 * | 3/2008 | Potterfield | 273/403 |
| 2009/0096172 | A1 * | 4/2009 | Beschorner | 273/408 |
| 2011/0260405 | A1 | 10/2011 | Acker | |
| 2012/0049460 | A1 * | 3/2012 | Little | 273/408 |

* cited by examiner

*Primary Examiner* — Mark Graham
(74) *Attorney, Agent, or Firm* — Foley & Lardner LLP

(57) ABSTRACT

An archery target includes an impact-absorbing core configured to arrest an incoming projectile and a multilayered bag enveloping the impact-absorbing core and defining an outer surface of the target. The multilayered bag includes a flexible fabric layer comprising a plurality of interwoven fibers and a polyurethane coating layer applied to the flexible fabric layer and at least partially overlapping the flexible fabric layer such that the polyurethane coating layer at least partially fills spaces between the plurality of interwoven fibers. The fabric layer may be a woven polyester fabric having a denier rating of at least one thousand. The archery target may further include a marking defining a target area. The marking may be applied to the multilayered bag using a dye sublimation process.

15 Claims, 9 Drawing Sheets

ARCHERY TARGET WITH COATED LINER

BACKGROUND

The present description relates generally to an archery target configured to receive a pointed projectile, such as an arrow. More particularly, the present description relates to an archery target having a coated liner which enables detailed printing and extends the target's useful life.

Archery targets exist in a variety of different forms. Generally, archery targets include marking (e.g., a bull's eye, a ring, etc.) indicating a target area which an archer attempts to strike with an arrow. Some archery targets are simple paper targets on which the target marking is printed, drawn, or otherwise provided Such paper targets are typically attached to a foam block or other material capable of stopping an incoming projectile and are usually discarded after a single use.

Other archery targets are intended to be more durable and are capable of reuse. For example, compression bag targets feature a packed material inside a bag. Typically, the bag is formed from a woven polypropylene material and may include a target marking printed on a surface of the woven material. However, after repeated strikes from a pointed projectile, certain portions of such targets (e.g., the portions including the target marking) are likely to deteriorate, thereby requiring the targets to be replaced. For example, with respect to compression bag targets, the woven fibers often break when impacted by an arrow. Such breakage can result in large holes in the target after repeated arrow strikes.

Advances in materials science have produced materials capable of self-repair after being damaged (e.g., punctured by an arrow). Such "self healing" or "self sealing" materials can extend the life of a target by providing some degree of self-repair to counter the deterioration caused by repeated arrow strikes. However, it is difficult to effectively and permanently embed a target marking on such materials.

SUMMARY

One implementation of the present disclosure is an archery target including an impact-absorbing core configured to arrest an incoming projectile and a multilayered bag enveloping the impact-absorbing core. The multilayered bag defines an outer surface of the target and includes a flexible fabric layer comprising a plurality of interwoven fibers and a polyurethane coating layer applied to the flexible fabric layer. The polyurethane coating at least partially overlaps the flexible fabric layer such that the polyurethane coating layer at least partially fills spaces between the plurality of interwoven fibers. In some embodiments, the plurality of interwoven fibers have a denier rating of at least one thousand. In some embodiments, the polyurethane coating layer has a thickness between two millimeters and four millimeters. In some embodiments, the polyurethane coating layer is applied to an inward-facing surface of the flexible fabric layer.

In some embodiments, the archery target further includes a marking defining a target area. The marking may be applied to the multilayered bag using a dye sublimation process. In some embodiments, the flexible fabric layer comprises a woven polyester fabric and the marking is sublimated to the woven polyester fabric. In some embodiments, the marking is applied to an outward-facing surface of the multilayered bag.

In some embodiments, the plurality of interwoven fibers are configured to reversibly displace in response to receiving an incoming projectile such that the incoming projectile penetrates the flexible fabric layer through a space between the plurality of interwoven fibers without breaking the fibers. In some embodiments, the polyurethane coating is configured to re-fill the space between the plurality of interwoven fibers in response to removing a captured projectile from the space.

In some embodiments, the archery target further includes a mechanism for repeatable opening and closing of the multilayered bag and for providing access to the impact-absorbing core. In some embodiments, the archery target further includes a handle extending from an upper portion of the multilayered bag. The handle may include a first end secured to the multilayer bag and a second end secured to the multilayer bag. In some embodiments, the handle includes a grip surrounding the handle between the first end and the second end.

Another implementation of the present disclosure is a multilayered archery target including a polyester fabric layer comprising a plurality of polyester fibers having a denier rating of at least one thousand, a polyurethane coating layer applied to the polyester fabric layer and at least partially overlapping the polyester fabric layer such that the polyurethane coating layer at least partially fills spaces between the plurality of polyester fibers, and a marking defining a target area. The marking may be applied to the multilayered archery target using a dye sublimation process. In some embodiments, the marking is sublimated to an outward-facing surface of the polyester fabric layer.

In some embodiments, the plurality of polyester fibers are configured to reversibly displace in response to receiving an incoming projectile such that the incoming projectile penetrates the polyester fabric layer through a space between the plurality of polyester fibers without breaking the fibers. In some embodiments, the polyurethane coating layer is applied to an inward-facing surface of the polyester fabric layer and fills the spaces between the plurality of polyester fibers such that an outward-facing surface of the polyester fabric layer is substantially smooth. In some embodiments, the multilayered archery target further includes one or more grommets defining holes extending through the multilayered archery target.

Another implementation of the present disclosure is a method for manufacturing a multilayered archery target including coating a first surface of a polyester fabric with a layer of polyurethane, applying a marking defining a target area to a second surface of the polyester fabric opposite the first surface using a dye sublimation process, forming the coated and marked polyester fabric into a multilayered bag, and inserting, into the multilayered bag, an impact-absorbing core configured to arrest an incoming projectile. In some embodiments, the polyester fabric comprises a plurality of polyester fibers having a denier rating of at least one thousand. In some embodiments, the method further includes attaching to the multilayered bag at least one of: a handle, a grommet, and a mechanism for repeatable opening and closing of the multilayered bag.

In some embodiments, coating the first surface of the polyester fabric with the layer of polyurethane includes at least partially filling spaces between the plurality of polyester fibers with the layer of polyurethane such that the layer of polyurethane at least partially overlaps the polyester fabric. In some embodiments, the layer of polyurethane has a thickness between two millimeters and four millimeters.

Those skilled in the art will appreciate that the foregoing summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Figure 1:
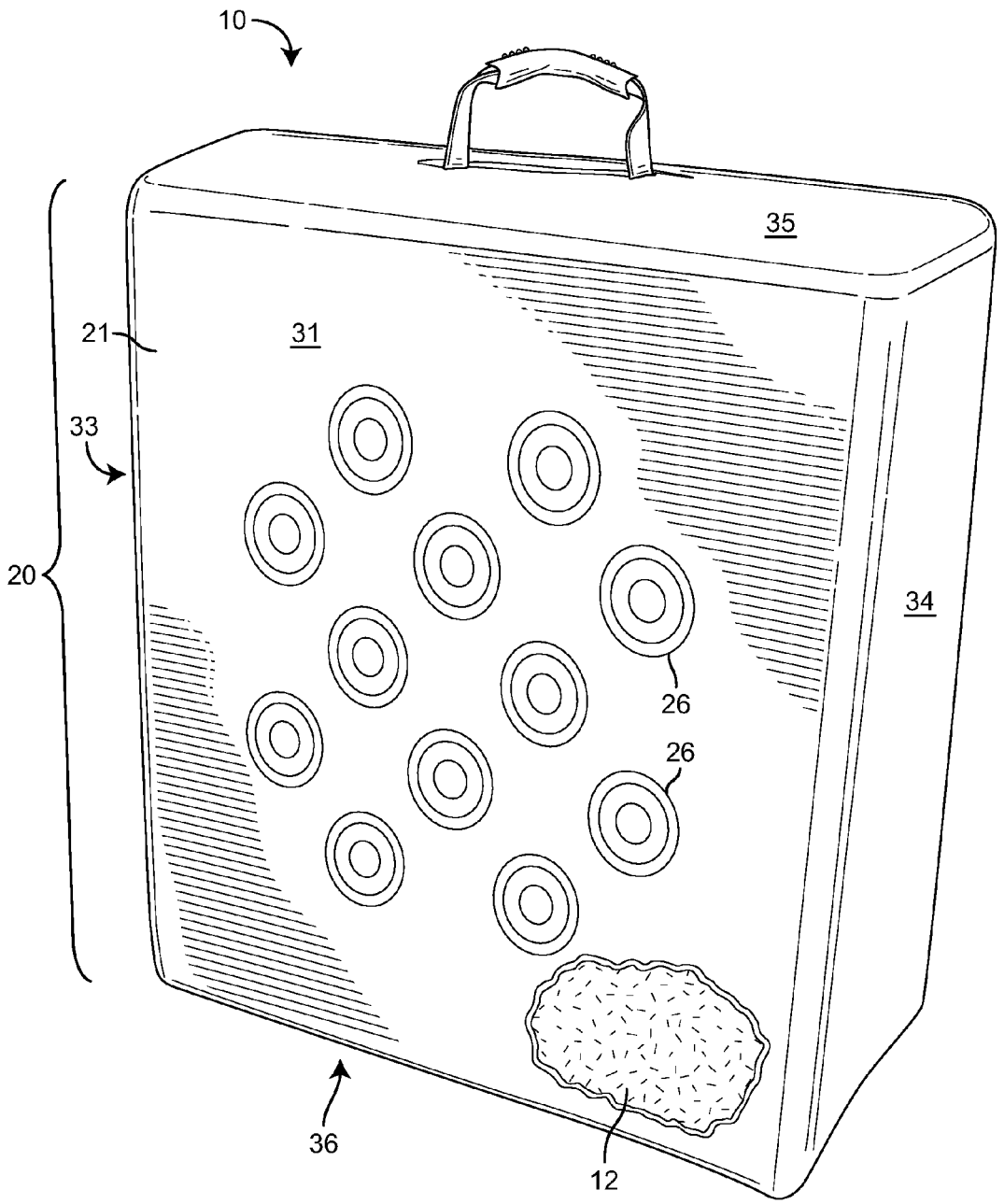
FIG. 1 is a front perspective view of an archery target including an impact-absorbing core and an outer bag formed from a multilayered material, according to an exemplary embodiment.

Referring generally to the FIGURES, an archery target and components thereof are shown according to various exemplary embodiments. The archery target is shown as a "bag target" including an impact-absorbing core and a multilayered outer surface (e.g., a bag) enveloping the impact-absorbing core. The impact-absorbing core may comprise any material capable of capturing and retaining an incoming projectile (e.g., an arrow). For example, the impact-absorbing core may include strips of polyester, polypropylene, Kevlar, ballistic nylon, foam beads, a foam block, or other suitable materials.

The multilayered bag provides a durable container for the impact-absorbing core and may be marked to present a target area (e.g., a bull's-eye, a circle, a ring, etc.). The multilayered bag includes a layer of flexible fabric (e.g., polyester fabric). The fabric layer includes a plurality of individual fibers which may be woven or non-woven. Advantageously, the plurality of fibers are configured to receive an incoming projectile without breaking, tearing, or otherwise permanently deforming. For example, in some embodiments, the plurality of fibers have a denier rating (e.g., a measurement of linear mass density) of at least one thousand. When an incoming projectile impacts the fabric layer, the nearby fibers may reversibly displace (e.g., bend, move, etc.) and allow penetration of the projectile through a space between the fibers without breaking the fibers. The high denier rating increases fiber strength reduces the potential for breakage caused by repeated arrow strikes.

Traditional bag targets have not used fabrics having a high denier rating due to the difficulty of embedding a target marking on such fabrics. Advantageously, the archery target described herein overcomes this difficulty by coating the fabric layer with a layer of polyurethane. The polyurethane coating may at least partially overlap with the fabric layer and at least partially fill the spaces between the high denier fibers. The resulting multilayered material is suitable for applying a target marking (e.g., using a dye sublimation process) while providing improved durability and resistance to fiber breakage. Furthermore, the polyurethane coating may re-fill the spaces between fibers in response to the removal of an arrow from such spaces, thereby providing a degree of self-healing for the multilayered bag material.

Before discussing further details of the archery target and/or the components thereof, it should be noted that references to "front," "back," "rear," "upper," "bottom," "right," and "left" in this description are merely used to identify the sides and/or surfaces of the archery target as they are oriented in the FIGURES. The terms "inward-facing" and "outward-facing" refer to directions toward and away from, respectively, the approximate center of the archery target and/or designated parts thereof. These terms are not meant to limit the element which they describe, as the various elements may be oriented differently in various applications. It should further be noted that for purposes of this description, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or alternatively may be removable, releasable, or reversible in nature.

Figure 2:
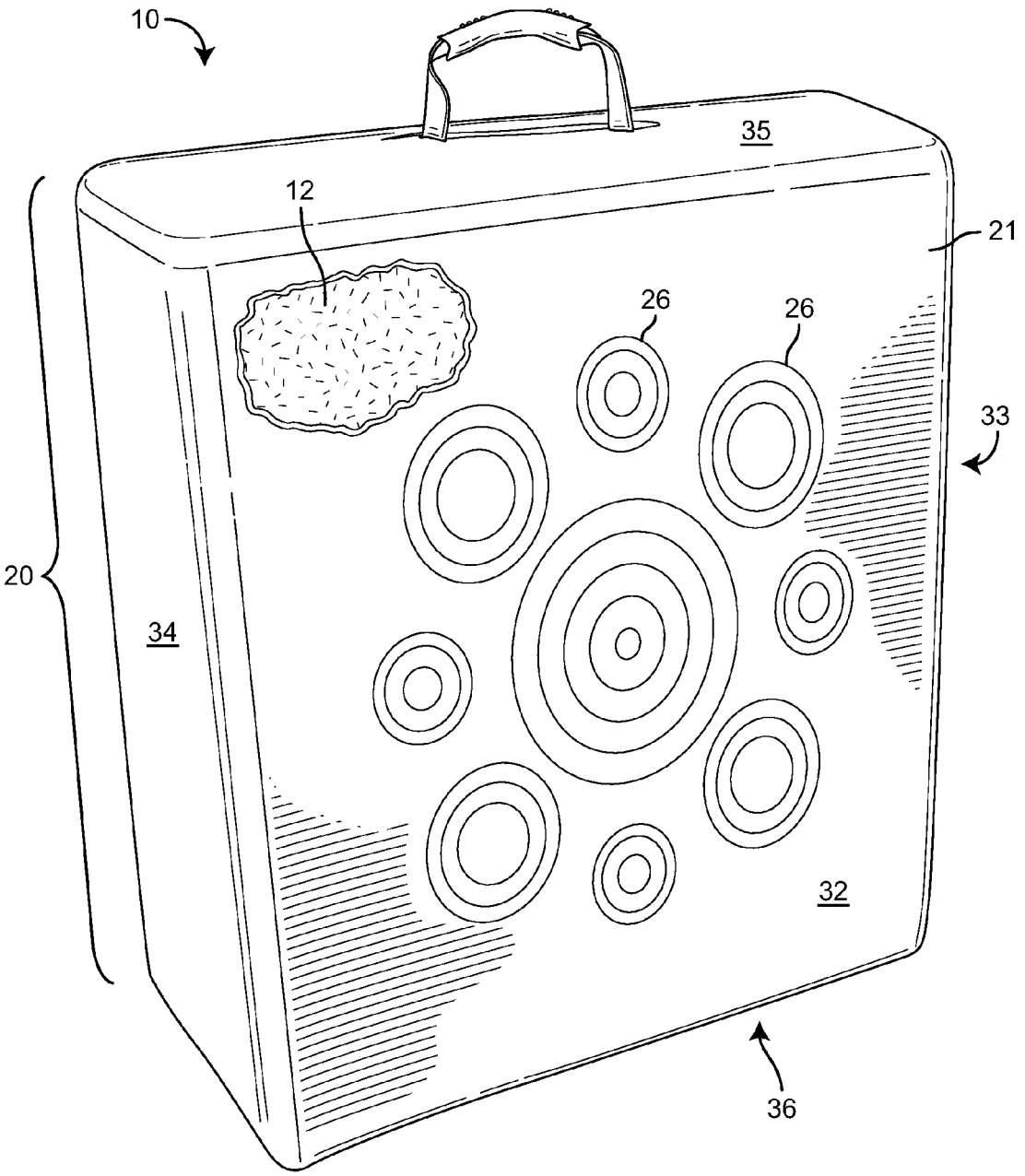
FIG. 2 is a rear perspective view of the archery target of FIG. 1, according to an exemplary embodiment.

Referring now to FIGS. 1-2, a front perspective view (FIG. 1) and a rear perspective view (FIG. 2) of an archery target 10 are shown, according to an exemplary embodiment. In some embodiments, archery target 10 is a "bag target" including an impact-absorbing core 12 and an outer bag 20. Impact-absorbing core 12 may comprise any material capable of arresting an incoming projectile (e.g., an arrow). In some embodiments, impact-absorbing core 12 may include strips of polyester fabric, polypropylene fabric, Kevlar, ballistic nylon, or other materials which are impermeable or substantially impermeable to an incoming projectile. In other embodiments, impact-absorbing core 12 may include foam beads, a foam block, or other materials capable of capturing and retaining an arrow. In some embodiments, impact-absorbing core 12 is at least partially formed from a self-healing material. Such self healing-materials may include, for example, small cell cellular plastic or rubber, open cell styrene butadiene rubber (SBR) foam, open cell styrene, or other materials capable of self-repair (e.g., filling a hole, sealing a gap, etc.) upon the removal of an arrow from impact-absorbing core 12.

Impact-absorbing core 12 may be configured to minimize the force of impact experienced by the incoming projectile (e.g., by gradually arresting the projectile, by providing cushioning, etc.). In some embodiments, impact-absorbing core 12 is configured to reduce the friction generated upon impact, thereby reducing the potential for heat-related damage (e.g., melting, burning, warping, etc.) to both the incoming projectile and to archery target 10. Furthermore, the reduced friction may facilitate removal of captured arrows from archery target 10 without requiring any sort of lubricant or a removal device. Impact-absorbing core 12 may retain captured arrows in a rigid position or in a flexible position.

Outer bag 20 may completely envelop and/or contain impact-absorbing core 12 and provide an external housing for archery target 10. In some embodiments, outer bag 20 may be formed from a multilayered material 21. Thus, outer bag 20 may be referred to as a multilayered bag. Outer bag 20 is shown to include a plurality of markings 26 visible on an outward-facing surface thereof. Markings 26 may be target markings (e.g., bull's-eyes, circles, rings, etc.) indicating a target area at which an archer can take aim. Markings 26 may be applied to multilayered material 21 using a dye sublimation process or any other suitable marking technique.

Still referring to FIGS. 1-2, the shape and size of outer bag 20 and impact-absorbing core 12 may vary depending on the particular application of archery target 10. In some embodiments, outer bag 20 and impact-absorbing core 12 are sized and/or shaped to facilitate the portability of archery target 10. According to an exemplary embodiment, archery target 10 has a height and a width of approximately 22 inches and depth of approximately 6 inches. According to the various alternative embodiments, archery target 10 may have dimensions greater than or less than those provided herein while still being sized to be portable.

Archery target 10 is shown to include a plurality of sides or faces that may define one or more target zones. Advantageously, providing a target with multiple sides and/or target zones may improve the versatility of archery target 10 by enabling the archer to take any of a number of positions relative to the target 10. For example, the archer can shoot target 10 from above, below, in front of, or behind the target. Further, providing a target with multiple sides and target zones may allow a single target to be used for different types of practice (e.g., arrow placement, honing, etc.).

In some embodiments, archery target 10 is a hexahedral (i.e., six-sided) object having a first face or front surface 31, a second face or rear surface 32, a third face or left side surface 33, a fourth face or right side surface 34, a fifth face or top surface 35 and a sixth face or bottom surface 36. Each of surfaces 31-36 may define one or more target zones or areas configured to receive a pointed projectile. In other embodiments, one or more of faces 31-36 (e.g., top surface 35, bottom surface 36, etc.) may not include a target zone. In addition to defining one or more target zones, surfaces 31-36 may be configured to rest upon the ground or another surface to support archery target 10 in a relatively stable position. Such a configuration allows an archer to selectively turn or otherwise reposition archery target 10 to reveal or conceal different target zones.

As shown in FIGS. 1-2, front face 31 and rear face 32 may define opposing surfaces. Similarly, left side face 33 and right side face 34 may define opposing surfaces and top face 35 and bottom face 36 may define opposing surfaces. Each pair of opposing surfaces may be oriented substantially perpendicular to the other pairs of opposing surfaces. For example, front face 31 and rear face 32 are shown as substantially planar surfaces aligned at approximately 90 degrees angles relative to adjacent side surfaces 33 and 34 so as to form a substantially rectangular block. According to various alternative embodiments, archery target 10 may formed into any of a number of geometric shapes (e.g., a cube, sphere, tetrahedron, prism, cylinder, cone, etc.) or other shapes, such as of an animal (e.g., a deer, bear, fox or other game animal, etc.).

Figure 3:
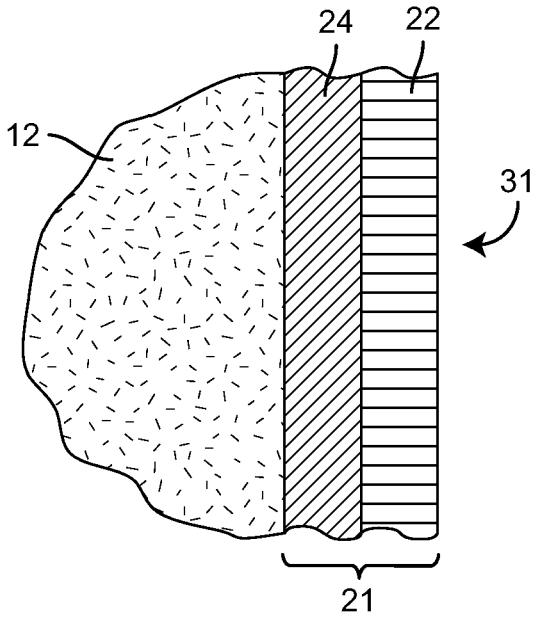
FIG. 3 is a cross-sectional view of the multilayered material of FIG. 1, shown to include a fabric layer comprising a plurality of individual fibers and a polyurethane coating applied to the fabric layer, according to an exemplary embodiment.
Figure 4:
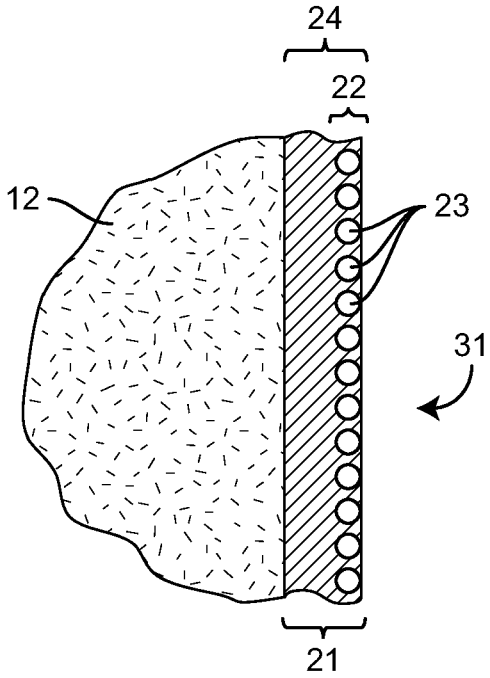
FIG. 4 is another cross-sectional view of the multilayered material illustrating the polyurethane coating at least partially overlapping the fabric layer and filling spaces between the plurality of fibers, according to an exemplary embodiment.

Referring now to FIGS. 3-4, a cross-sectional view of multilayered material 21 is shown, according to multiple exemplary embodiments. In some embodiments, multilayered material 21 may be used to form outer bag 20 by folding, stitching, joining, or otherwise uniting sheets of multilayered material 21 (e.g., into the shape of a bag). In other embodiments, multilayered material 21 may be used as a standalone target (e.g., without impact-absorbing core 12, without forming outer bag 20, etc.). Multilayered material 21 is shown to include a fabric layer 22 and a polyurethane layer 24.

Fabric layer 22 may comprise a flexible (e.g., soft, non-rigid, etc.) fabric such as polyester, polypropylene, cotton, or other natural or synthetic fabric materials. Fabric layer 22 is shown to include a plurality of individual fibers 23. Fibers 23 may include multiple rows of substantially horizontal fibers and multiple columns of substantially vertical fibers. Fibers 23 may be woven (e.g., in an alternatively overlapping woven pattern) or non-woven (e.g., in an overlaid mesh). In an exemplary embodiment, fibers 23 are woven polyester fibers.

Advantageously, fibers 23 may be configured to receive an incoming projectile without breaking, tearing, or otherwise permanently deforming. In some embodiments, fibers 23 have a denier rating (e.g., a measurement of linear mass density) of at least 1000. This high denier rating may advantageously increase fiber strength and reduce the potential for fiber breakage caused by repeated arrow strikes. In some embodiments, fibers 23 may have a higher denier rating (e.g., of at least 1200, at least 1400, at least 1600, at least 1800, etc.) or a lower denier rating (e.g., at least 800, at least 600, at least 400, etc.). In a preferred embodiment, fibers 23 have a denier rating of approximately 1680. Traditional bag targets have not used fabrics having a denier rating in excess of 1000 due to the difficulty of embedding a target marking on such fabrics. Archery target 10 overcomes this difficulty by coating fabric layer 22 with a polyurethane layer 24.

Polyurethane layer 24 may comprise any type of polyurethane, resin, epoxy, or other similar coating. In some embodiments, polyurethane layer 24 includes a polymer composed of a chain of organic units joined by carbamate (e.g., urethane) links. Polyurethane layer 24 may include a thermosetting polymer (e.g., that does not melt when heated) or a thermoplastic polymer (e.g., that melts or softens when heated). Polyurethane layer 24 may be formed by reacting an isocyanate with a polyol. In some embodiments, both the isocyanates and polyols used to make polyurethane layer 24 may contain, on average, two or more functional groups per molecule. Polyurethane layer 24 may include any number or type of chain extenders, cross-linkers, catalysts, surfactants, and/or other molecular additives.

In some embodiments, polyurethane layer 24 may be applied to fabric layer 22 by spraying (e.g., as a fine mist) liquid polyurethane components (e.g., mixed or unmixed isocyanates, polyols, etc.) onto a surface of fabric layer 22. Polyurethane layer 24 may be applied to an inward-facing surface of fabric layer 22, an outward-facing surface of fabric layer 22, or both surfaces of fabric layer 22. In some embodiments, polyurethane layer 24 may have a thickness between two millimeters and four millimeters. In an exemplary embodiment, polyurethane layer 24 may have a thickness of approximately three millimeters.

In some embodiments (shown in FIG. 3), fabric layer 22 and polyurethane layer 24 may be discrete layers (e.g., occupying none of the same physical space). In other embodiments (shown in FIG. 4), fabric layer 22 and polyurethane layer 24 may at least partially overlap. For example, polyurethane layer 24 may at least partially fill the spaces between fibers 23. By filling the spaces between fibers 23, polyurethane layer 24 may smooth the outward-facing surface of multilayered material 21. Advantageously, such smoothing may result in an improved ability to apply markings 26 to outer bag 20, thereby overcoming the marking difficulties presented by using fibers 23 having a high denier rating (e.g., in excess of one thousand). In other words, the resulting multilayered material 21 is suitable for applying a target marking (e.g., using a dye sublimation process) while providing improved durability (e.g., as a result of the high denier rating, the interaction between polyurethane layer 24 and fabric layer 22, etc.).

In some embodiments, polyurethane layer 24 provides additional advantages to multilayered material 21 and archery target 10. For example, polyurethane layer 24 may hold together fibers 23 to prevent gaps or holes from forming in multilayered material 21. Polyurethane layer 24 may provide water resistance or waterproofing to multilayered material 21. Furthermore, polyurethane layer 24 may re-fill spaces between fibers 23 in response to the removal of an arrow from such spaces, thereby providing a degree of self-healing for multilayered material 21.

Figure 5:
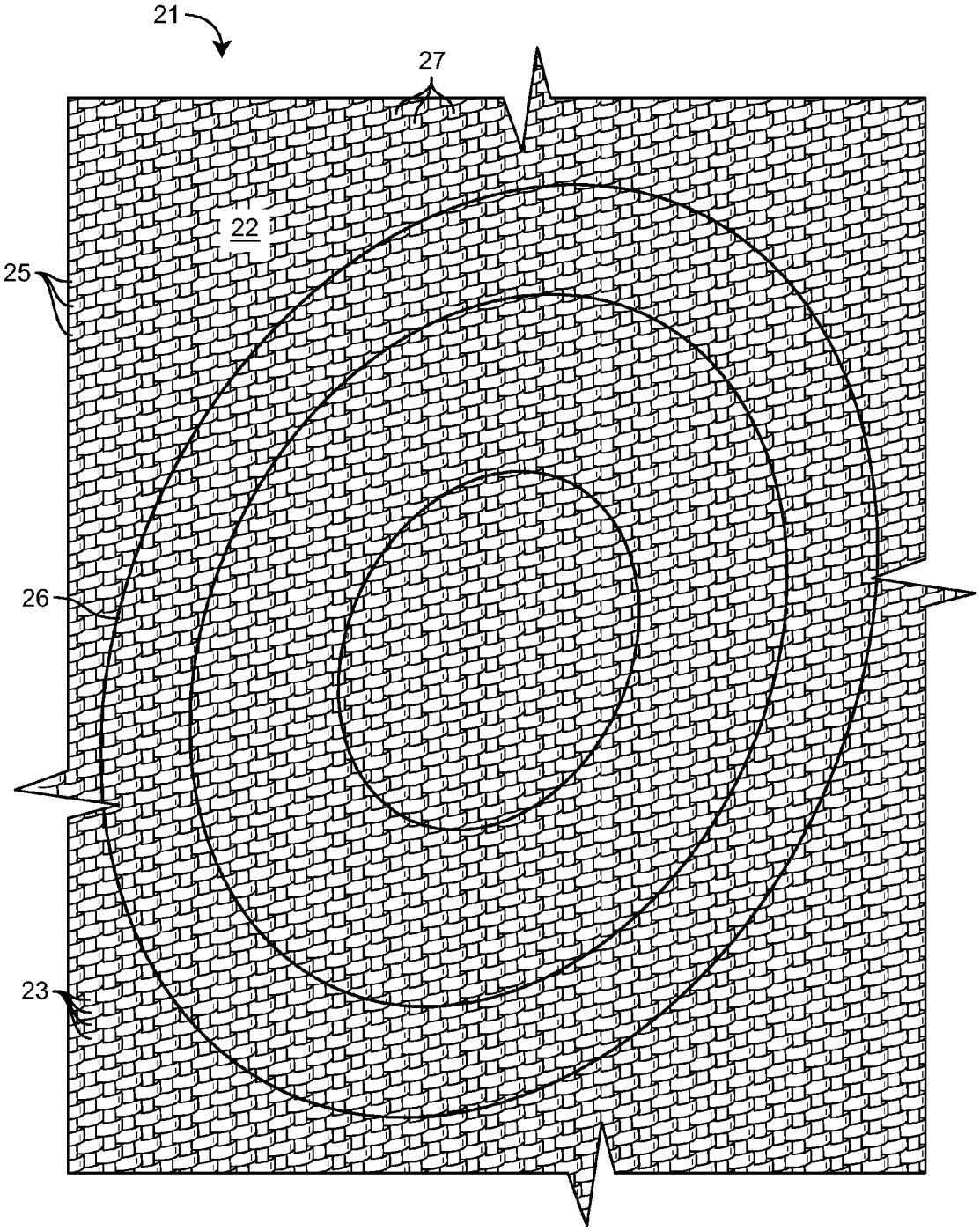
FIG. 5 is a perspective view of the multilayered material, showing a target marking applied to an outward-facing surface of the fabric layer and a plurality of interwoven fibers comprising the fabric layer, according to an exemplary embodiment.
Figure 6:
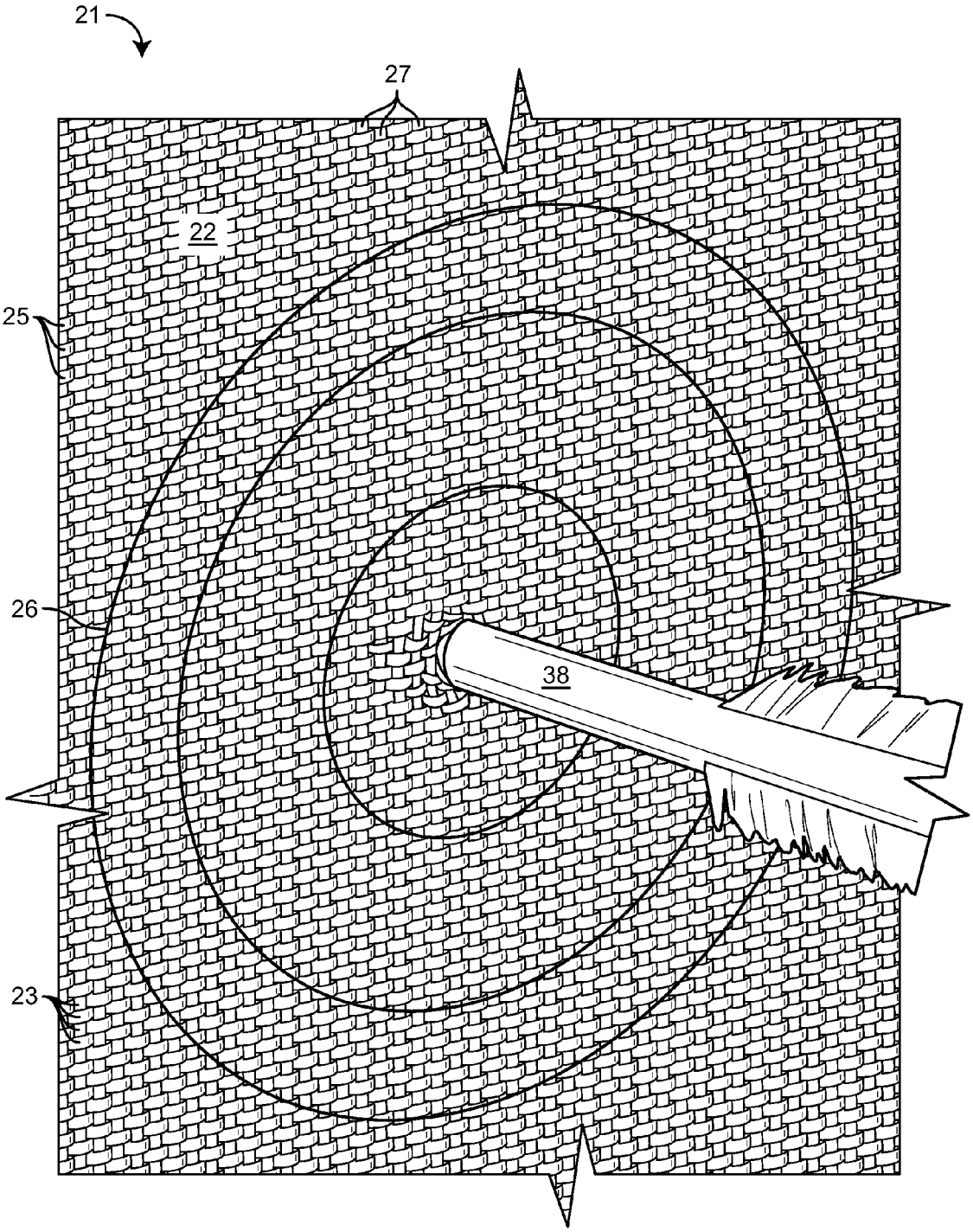
FIG. 6 is another perspective view of the multilayered material, showing the plurality of interwoven fibers reversibly displacing in response to receiving an incoming projectile, according to an exemplary embodiment.

Referring now to FIGS. 5-6, an external perspective view of multilayered material 21 is shown, according to an exemplary embodiment. Multilayered material 21 is shown to include a marking 26 on an outward-facing surface thereof (e.g., front surface 31). Marking 26 may be applied to multilayered material 21 using, for example, a dye sublimation process. In some embodiments, marking 26 may be applied to an outward-facing surface of multilayered material 21. In other embodiments, marking 26 may be applied to an inward-facing surface of multilayered material 21. Marking 26 may be applied to an opposite surface of multilayered material 21 from which polyurethane layer 24 is applied.

Multilayered material 21 is shown to include a plurality of fibers 23 comprising fabric layer 22. Fibers 23 are shown to include multiple rows 25 of substantially horizontal fibers and multiple columns 27 of substantially vertical fibers. Fibers 23 are shown as woven fibers. However, in other embodiments, fibers 23 may be non-woven. For example, rows 25 may be overlaid onto columns 27 and united with columns 27 (e.g., bonded, held together, joined, etc.) by polyurethane layer 24.

As shown in FIG. 6, when an incoming projectile 38 impacts fabric layer 22, nearby fibers 23 may reversibly displace (e.g., bend, move, etc.) and allow penetration of projectile 38 through a space between fibers 23. Advantageously, such penetration may occur without breaking fibers 23 (e.g., due to the high denier rating of fibers 23). When projectile 38 is removed, fibers 23 may return to their previous locations, thereby closing the enlarged space between fibers 23. In some embodiments, the matrix formed by polyurethane layer 24 may provide elasticity to fibers 23, thereby causing fibers 23 to return to their previous locations upon removal of projectile 38. In some embodiments, polyurethane layer 24 may at least partially fill refill the enlarged space between fibers 23 upon removal of projectile 38. For example, friction and/or shear stress caused by the penetration of projectile 38 may generate heat in the area of arrow penetration. Such heat may soften polyurethane layer 24 around the area of penetration, thereby causing polyurethane layer 24 to flow and/or plastically deform into the open space upon removal of projectile 38.

Figure 7:
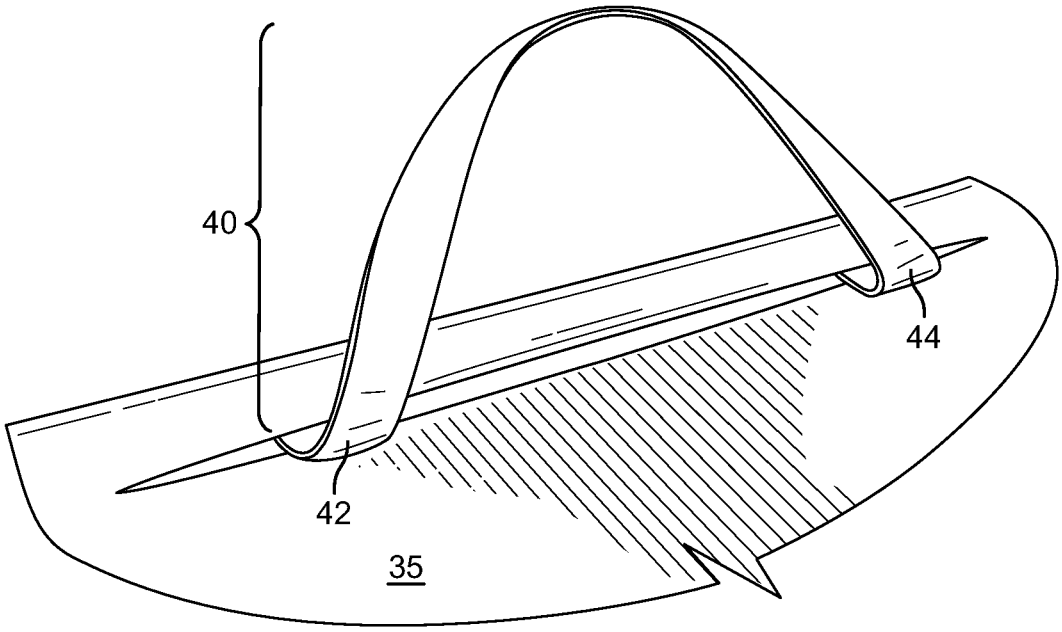
FIG. 7 is a top perspective view of the archery target, showing a handle attached to an upper surface of the outer bag, according to an exemplary embodiment.
Figure 8:
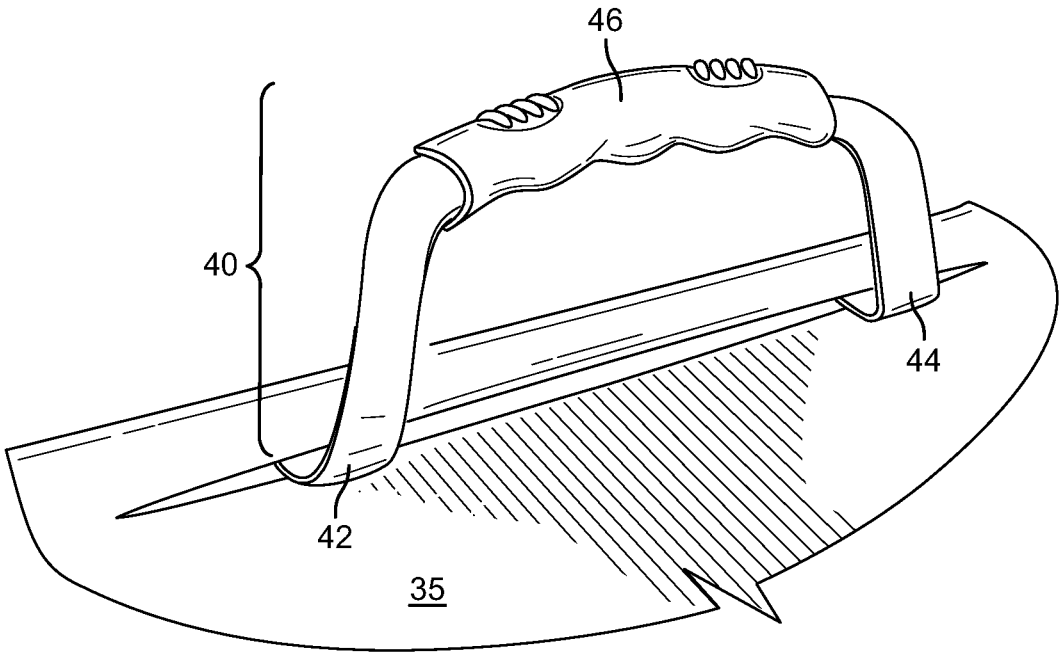
FIG. 8 is another top perspective view of the archery target, showing an alternate embodiment of the handle including an ergonomic grip, according to an exemplary embodiment.

Referring now to FIGS. 7-8, a top perspective view of archery target 10 is shown, according to an exemplary embodiment. In some embodiments, archery target 10 may include a handle 40. Handle 40 is shown to include a first end 42 and a second end 44. Handle 40 may be secured (e.g., stitched, bonded, joined, etc.) to an external surface of outer bag 20 at ends 42 and 44. In some embodiments, ends 42 and 44 are attached to top surface 35 of outer bag 20. In some embodiments, multiple handles 40 may be present. For example archery target 10 may include a handle extending from left side surface 33 and/or right side surface 34 in addition to or in place of handle 40. In some embodiments, handle 40 includes a hand grip 46. Hand grip 46 may be a sleeve surrounding handle 40 between ends 42 and 44. In some embodiments, hand grip 46 may be made of rubber or another durable polymeric material. Hand grip 46 may be ergonomically designed to facilitate the portability of archery target 10.

Figure 9:
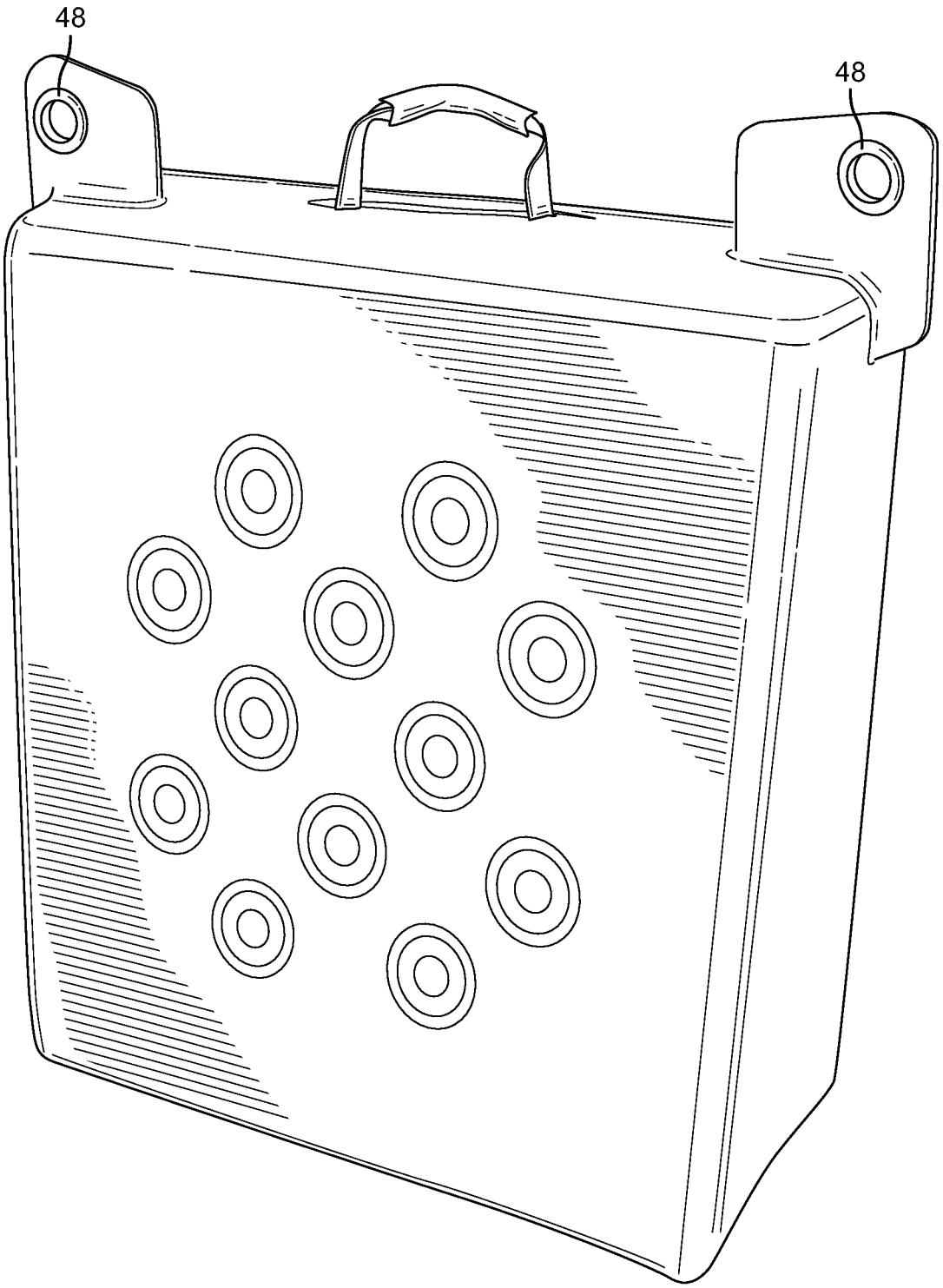
FIG. 9 is a perspective view of the archery target, showing optional grommets defining holes extending through the multilayered material, according to an exemplary embodiment.

Referring now to FIG. 9, in some embodiments, archery target 10 may include grommets 48. Grommets 48 may be holes through multilayered material 21. Any number of grommets 48 may be present. Grommets 48 may be reinforced (e.g., with an inserted ring, with a reinforcing stitch, etc.) to provide durable locations for mounting multilayered material 21. Grommets 48 may be used to hang archery target 10 in an elevated position as an alternative to resting archery target 10 upon the ground or other floor surface. For embodiments in which multilayered material 21 is formed into outer bag 20, grommets 48 may be used to hang or otherwise secure outer bag 20 to one or more elevated posts, pegs, clips, or other fastening devices.

As previously described, in some embodiments, multilayered material may be used without impact-absorbing core 12 and/or without forming multilayered material 21 into outer bag 20. For embodiments in which multilayered material 21 is used without impact-absorbing core 21, grommets 48 may be used to hang or otherwise secure multilayered material 21 to a projectile-arresting element (e.g., a foam block, a solid backing, a separate impact-absorbing material, etc.). In some embodiments, grommets 48 may be provided in one or more corners of archery target 10 (e.g., upper corners, lower corners, etc.). In other embodiments, a grommet 48 may be centered along a top edge of archery target 10 (e.g., in the case of a single grommet 48) or elsewhere located about archery target 10.

Figure 10:
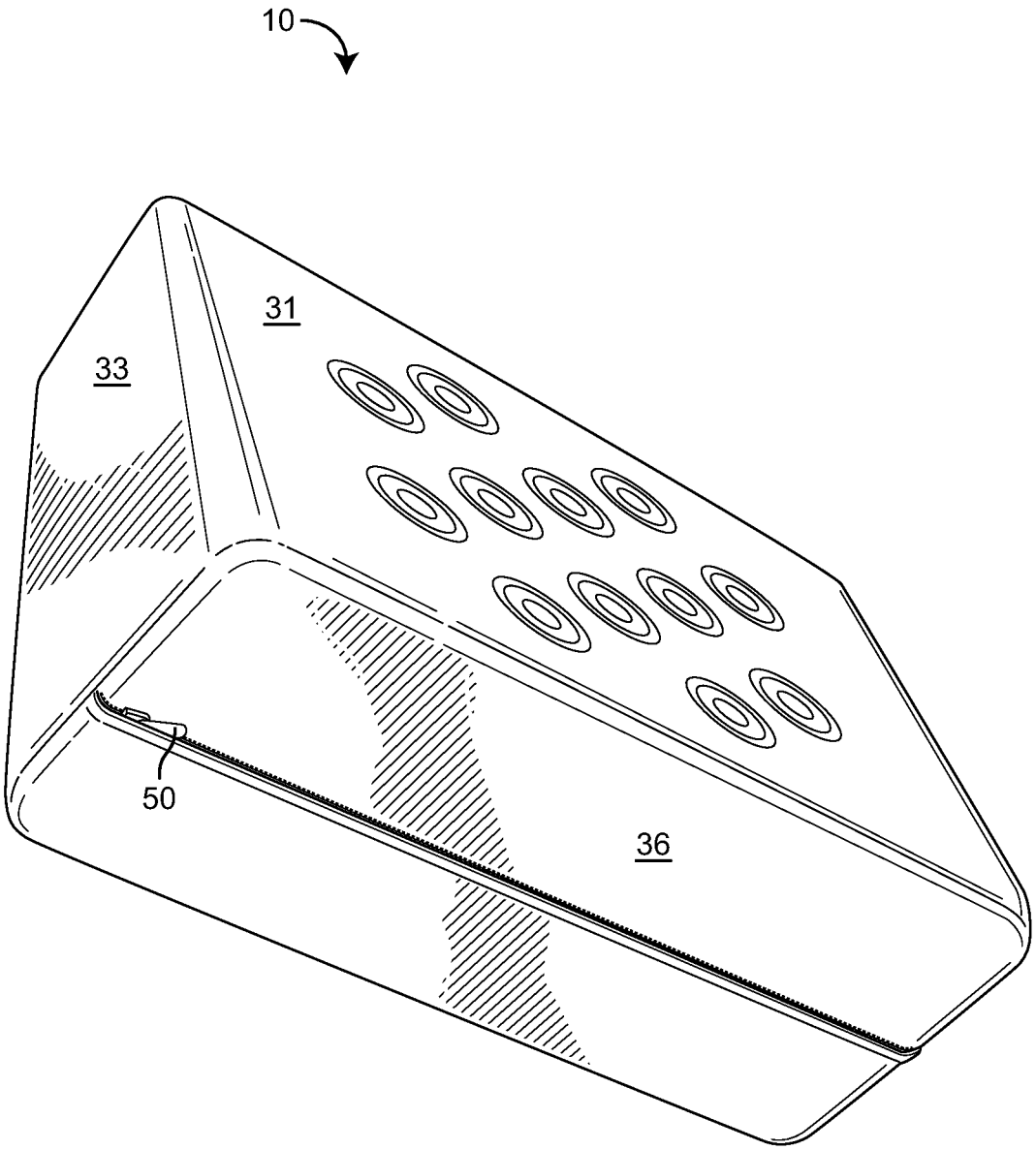
FIG. 10 is a bottom perspective view of the archery target, showing a mechanism for repeatable opening and closing of the outer bag, according to an exemplary embodiment.

Referring to FIG. 10, a bottom perspective view of archery target 10 is shown, according to an exemplary embodiment. In some embodiments, archery target 10 includes a mechanism 50 for repeatable opening and closing of outer bag 20. For example, mechanism 50 is shown as a zipper extending along a length of bottom surface 36. In other embodiments, mechanism 50 may include snaps, latches, hooks, buttons, or any other mechanism which allows for repeatable opening and closing. Advantageously, mechanism 50 may be used to access or alter impact-absorbing core 12. For example, impact-absorbing core 12 may be reoriented (e.g., rotated, shifted, etc.), supplemented (e.g., with additional fabric strips, additional foam, etc.), repaired, or replaced (e.g., swapped for another core, etc.) as a result of the access granted via mechanism 50.

Figure 11:
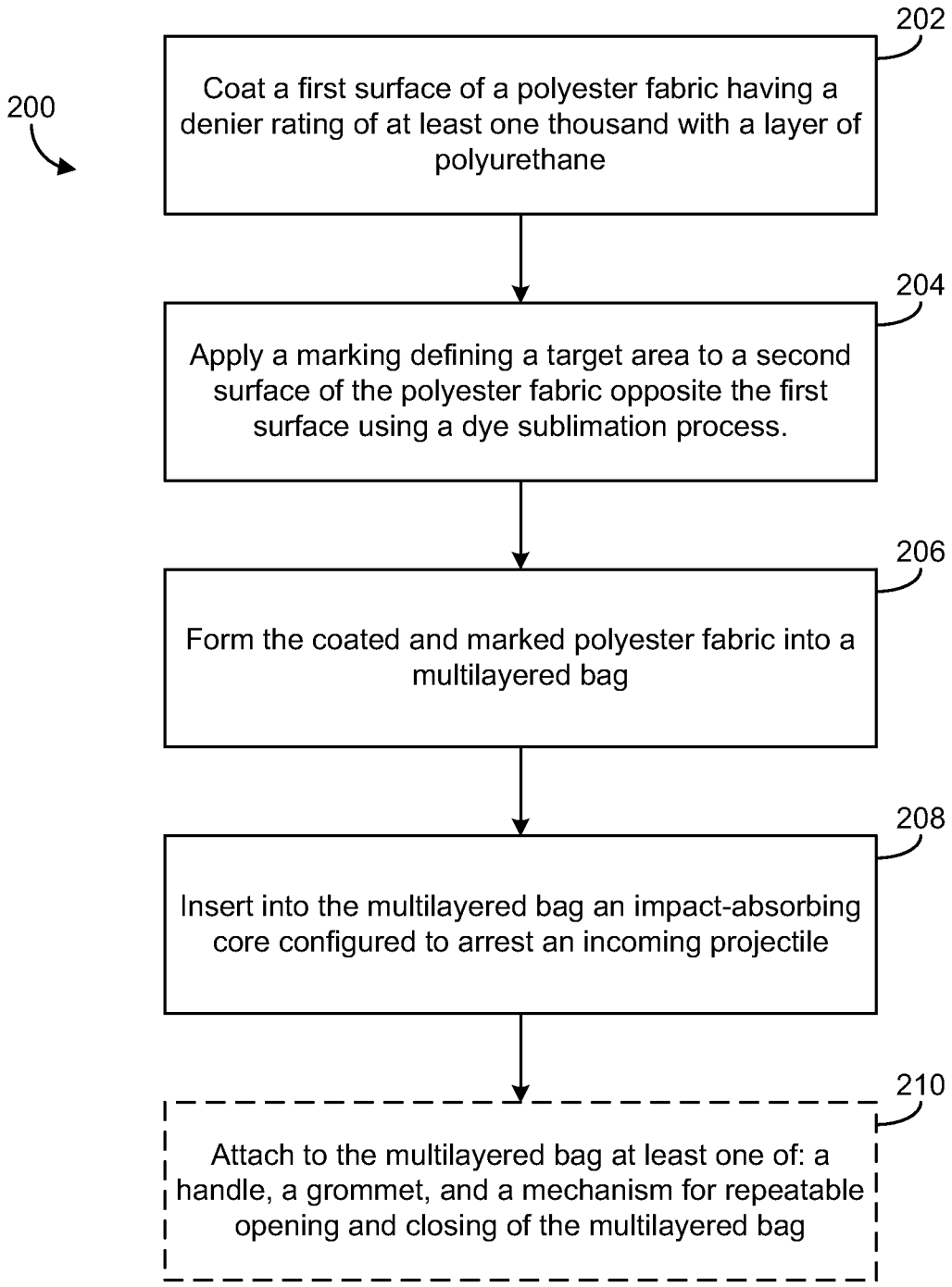
FIG. 11 is a flowchart of a process for manufacturing a multilayered archery target, according to an exemplary embodiment

Referring now to FIG. 11, a flowchart of a process 200 for manufacturing a multilayered archery target is shown, according to an exemplary embodiment. Process 200 may be used to create multilayered material 21 and optionally form multilayered material 21 into outer bag 20. Process 200 is shown to include coating a first surface of a polyester fabric having a denier rating of at least one thousand with a layer of polyurethane (step 202). In various embodiments, the polyester fabric has a denier rating of at least 1200, at least 1400, at least 1600, or at least 1800. In an exemplary embodiment, the polyester fabric has a denier rating of approximately 1680. The polyester fabric includes a plurality of polyester fibers which may be woven or non-woven.

Advantageously, the high denier rating (e.g., of at least one thousand) may improve the strength of the polyester fibers and prevent the fibers from breaking when impacted by an arrow. The polyester fibers may reversibly displace in response to receiving an incoming projectile, thereby allowing the projectile to pass through a space between fibers without breaking, tearing, or otherwise damaging the fibers comprising the polyester fabric.

The polyurethane coating may be applied to one or both surfaces of the polyester fabric. In some embodiments, the polyurethane coating has a thickness between two millimeters and four millimeters. In an exemplary embodiment, the polyurethane coating has a thickness of approximately three millimeters. In some embodiments, the polyurethane coating may at least partially overlap with the polyester fabric such that the polyurethane coating at least partially fills spaces between the plurality of polyester fibers. The polyurethane coating may hold the fibers together, provide water resistance or waterproofing, provide elasticity to the plurality of fibers (e.g., such that the fibers return to their original positions after removal of a projectile), refill spaces between fibers upon the removal of an arrow, or provide other advantages for the multilayered material.

Process 200 is shown to further include applying a marking defining a target area to a second surface of the polyester fabric opposite the first surface using a dye sublimation process (step 204). In some embodiments, the marking is a target marking (e.g., a bull's-eye, circle, ring, etc.) indicating a target area at which an archer can take aim. In other embodiments, the marking may be a product logo, a decal, or other image applied to the polyester fabric. Advantageously, the polyurethane coating applied in step 202 may facilitate application of the marking by smoothing the second surface. This advantage allows a crisp and clear marking to be applied to the polyester fabric while maintaining the fiber strength and durability resulting from the use of a fabric with a high denier rating.

In some implementations, process 200 may be terminated after completing step 204. Terminating process 200 after completing step 204 results in the formation of multilayered material 21 as previously described. Multilayered material 21 may be used as a standalone target without forming material 21 into a bag or inserting an impact-absorbing core into the bag. In other implementations, process 200 may be continued to form the bag target shown in FIGS. 1-2.

Process 200 is shown to further include forming the coated and marked polyester fabric into a multilayered bag (step 206) and inserting, into the multilayered bag, an impact-absorbing core configured to arrest an incoming projectile (step 208). In some embodiments, forming the coated and marked polyester fabric into a bag may include folding a single sheet of multilayered material 21 into the shape of a bag. In other embodiments, multiple sheets of material 21 may be joined, united, or otherwise combined to form the multilayered bag.

In some embodiments, the impact-absorbing core may include strips of polyester fabric, polypropylene fabric, Kevlar, ballistic nylon, or other materials which are impermeable or substantially impermeable to an incoming projectile. In other embodiments, the impact-absorbing core may include foam beads, a foam block, or other materials capable of capturing and retaining an arrow. In some embodiments, the impact-absorbing core is at least partially formed from a self-healing material. Such self healing-materials may include, for example, small cell cellular plastic or rubber, open cell styrene butadiene rubber (SBR) foam, open cell styrene, or other materials capable of self-repair (e.g., filling a hole, sealing a gap, etc.) upon the removal of an arrow from the impact-absorbing core.

In some embodiments, process 200 may further include attaching to the multilayered bag at least one of: a handle, a grommet, and a mechanism for repeatable opening and closing of the multilayered bag (step 210). The handle may be a strap of fabric attached (e.g., sewn, riveted, adhered, etc.) to the multilayered bag at either or both ends of the handle. In some embodiments, an ergonomic grip (e.g., a rubber sleeve) may be added to the handle between the attached ends.

One or more grommets may be provided to hang the archery target in an elevated position as an alternative to resting the archery target upon the ground or other floor surface. The grommets may be holes through multilayered material 21 which are reinforced (e.g., with an inserted ring, with a reinforcing stitch, etc.) to provide durable locations for mounting multilayered material 21. Any number of grommets may be present. The mechanism for repeatable opening and closing of the multilayered bag may be a zipper, snaps, latches, hooks, buttons, or any other mechanism which allows for repeatable opening and closing of the multilayered bag.

The construction and arrangement of the elements of the archery target as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. The elements and assemblies may be constructed from any of a wide variety of materials that provide sufficient strength or durability, in any of a wide variety of colors, textures, and combinations. Additionally, in the subject description, the word "exemplary" is used to mean serving as an example, instance, or illustration. Any embodiment or design described herein as "exemplary" is not necessarily to be construed as preferred or advantageous over other embodiments or designs. Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. An archery target comprising:

an impact-absorbing core configured to arrest an incoming projectile; and a multilayered bag enveloping the impact-absorbing core and defining an outer surface of the target, wherein the multilayered bag includes:

a flexible fabric layer comprising a plurality of interwoven fibers, and a polyurethane coating layer applied to an inward-facing surface of the flexible fabric layer and at least partially overlapping the flexible fabric layer such that the polyurethane coating layer at least partially fills spaces between the plurality of interwoven fibers thereby smoothing an outward-facing surface of the multilayered bag, the smoothed outward-facing surface comprising a first portion occupied by the plurality of interwoven fibers and a second portion occupied by the polyurethane coating in the spaces between the plurality of interwoven fibers.

2. The archery target of claim 1, further comprising:

a marking defining a target area, wherein the marking is applied to the smoothed outward-facing surface of the multilayered bag using a dye sublimation process.

3. The archery target of claim 2, wherein the flexible fabric layer comprises a woven polyester fabric and the marking is sublimated to the woven polyester fabric.

4. The archery target of claim 1, wherein the plurality of interwoven fibers are configured to reversibly displace in response to receiving an incoming projectile such that the incoming projectile penetrates the flexible fabric layer through a space between the plurality of interwoven fibers without breaking the fibers.

5. The archery target of claim 4, wherein the polyurethane coating is configured to re-fill the space between the plurality of interwoven fibers in response to removing a captured projectile from the space.

6. The archery target of claim 1, wherein the plurality of interwoven fibers have a denier rating of at least one thousand.

7. The archery target of claim 1, wherein the polyurethane coating layer has a thickness between two millimeters and four millimeters.

8. The archery target of claim 1, further comprising:

a mechanism for repeatable opening and closing of the multilayered bag and for providing access to the impact-absorbing core.

9. The archery target of claim 1, further comprising:

a handle extending from an upper portion of the multilayered bag, wherein the handle includes a first end secured to the multilayer bag and a second end secured to the multilayer bag.

10. The archery target of claim 9, further comprising:

a grip surrounding the handle between the first end and the second end.

11. A multilayered archery target comprising:

a polyester fabric layer comprising a plurality of polyester fibers having a denier rating of at least one thousand;

a polyurethane coating layer applied to the polyester fabric layer and at least partially overlapping the polyester fabric layer such that the polyurethane coating layer at least partially fills spaces between the plurality of polyester fibers thereby smoothing an outward-facing surface of the multilayered archery target, the smoothed outward-facing surface comprising a first portion occupied by the plurality of polyester fibers and a second portion occupied by the polyurethane coating in the spaces between the plurality of polyester fibers; and a marking defining a target area, wherein the marking is applied to the smoothed outward-facing surface of the multilayered archery target using a dye sublimation process.

12. The multilayered archery target of claim 11, wherein the plurality of polyester fibers are configured to reversibly displace in response to receiving an incoming projectile such that the incoming projectile penetrates the polyester fabric layer through a space between the plurality of polyester fibers without breaking the fibers.

13. The multilayered archery target of claim 11, wherein the polyurethane coating layer is applied to an inward-facing surface of the polyester fabric layer.

14. The multilayered archery target of claim 11, wherein the marking is sublimated to an outward-facing surface of the polyester fabric layer.

15. The multilayered archery target of claim 11, further comprising:

one or more grommets defining holes extending through the multilayered archery target.

* * * * *